US006856094B2

(12) United States Patent
Sherman

(10) Patent No.: US 6,856,094 B2
(45) Date of Patent: Feb. 15, 2005

(54) ELECTRICAL SWITCH UTILIZING BALL FOR LAMPS AND LIKE APPLIANCES

(75) Inventor: Roger Sherman, Chelsea, MA (US)

(73) Assignee: Tensor Corporation, Chelsea, MA (US)

( * ) Notice: Subject to any disclaimer, the term of this patent is extended or adjusted under 35 U.S.C. 154(b) by 110 days.

(21) Appl. No.: 10/356,284

(22) Filed: Jan. 31, 2003

(65) Prior Publication Data

US 2004/0160195 A1 Aug. 19, 2004

(51) Int. Cl.[7] ..... H01J 13/46

(52) U.S. Cl. ..... 315/57; 315/70; 315/127; 315/362

(58) Field of Search ..... 315/57, 70, 276, 315/283, 362, 127, 119; 362/410–411, 427, 430, 441, 449; 307/139, 140

(56) References Cited

U.S. PATENT DOCUMENTS 4,985,661 A * 1/1991 Lin ..... 315/87
5,097,400 A * 3/1992 Cvek ..... 362/287
5,333,103 A * 7/1994 Cvek ..... 362/413
5,477,443 A * 12/1995 Cvek ..... 362/413
5,590,957 A * 1/1997 Chen ..... 362/419
5,677,896 A * 10/1997 Nunes ..... 368/10
6,599,000 B2 * 7/2003 Nolan et al. ..... 362/414

* cited by examiner

*Primary Examiner*—Thuy Vinh Tran
(74) *Attorney, Agent, or Firm*—Todd S. Parkhurst; Lewis T. Steadman, Sr.; Robert J. Depke

(57) ABSTRACT

A low voltage lamp is disclosed and claimed. The low voltage lamp includes a low voltage lamp switch having a first pole permanently connected to a remote source of electric power; a second pole permanently connected to a light; and a movable switch element permanently connected to the first pole and selectively movable into and out of electrical connection with the second pole. In the illustrated embodiment of the invention, the movable switch element includes a flexible cable having a first end connected to the first pole, and an electrically conductive ball mounted to the cable free end. The second pole here comprises a cup adapted to receive and electrically connect to a ball, and the second pole cup is electrically connected to a light.

14 Claims, 2 Drawing Sheets

ELECTRICAL SWITCH UTILIZING BALL FOR LAMPS AND LIKE APPLIANCES

BACKGROUND OF THE INVENTION

Electric lamps for desks and like home and office environments are ubiquitous. Lamps having high-intensity lights have become important in the marketplace. Especially attractive in the current marketplace are those lamps which embody modern, eye-catching designs, appearances and features.

It is an object of this invention to provide a desk lamp or like electrical appliances which has an attractive and unusual-appearing on-off lamp switch.

A related object is to provide a desktop lamp with an attractive on-off switch which operates at a harmlessly low voltage.

Another object is to provide an attractive desk lamp and associated on-off switch which are safe, reliable, rugged in operation, and yet economical to manufacture.

Yet another object is to provide an on-off lamp switch which includes no springs, tensioned parts or compressed parts for its operation.

Still another object is to provide an on-off switch for a lamp, the operation of which is self-evident yet interesting to the owner or user.

Other objects and advantages of the invention will become apparent upon reading the following detailed description and upon reference to the drawings. Throughout the drawings, like reference numerals refer to like parts.

DETAILED DESCRIPTION

Figure 1:
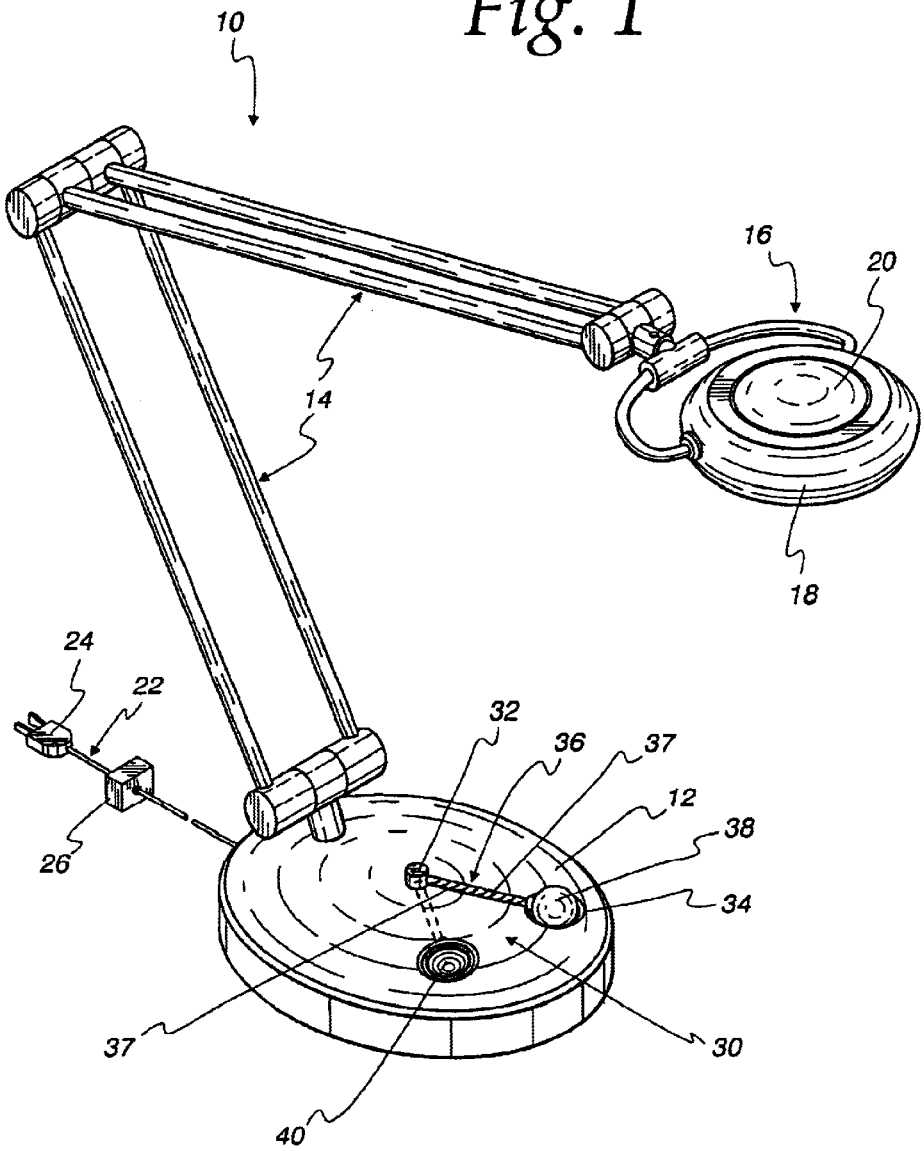
FIG. 1 is an isometric view of a lamp having an on-off switch embodying the present invention.
Figure 2:
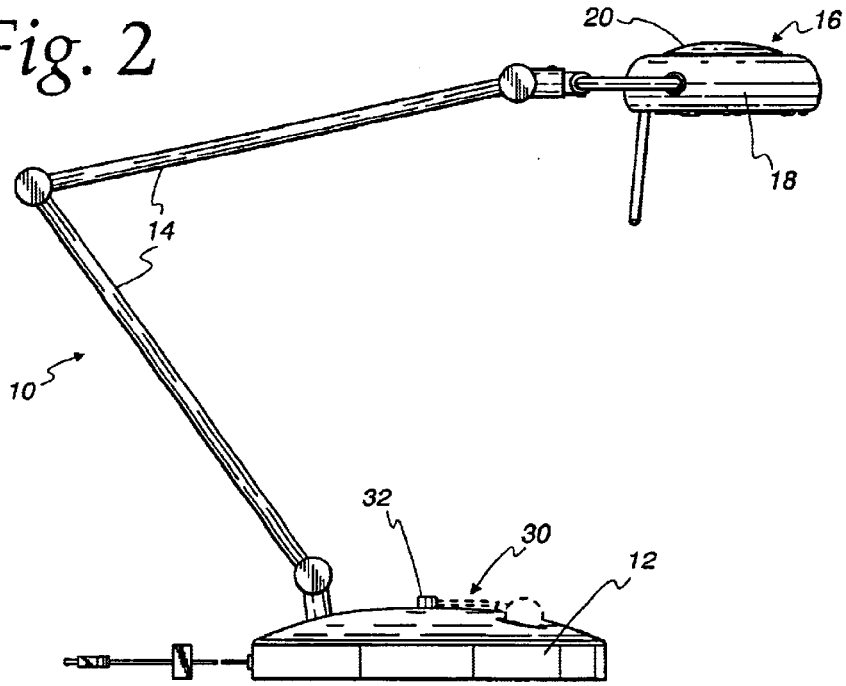
FIG. 2 is a right side elevational view of the lamp shown in FIG. 1.
Figure 3:
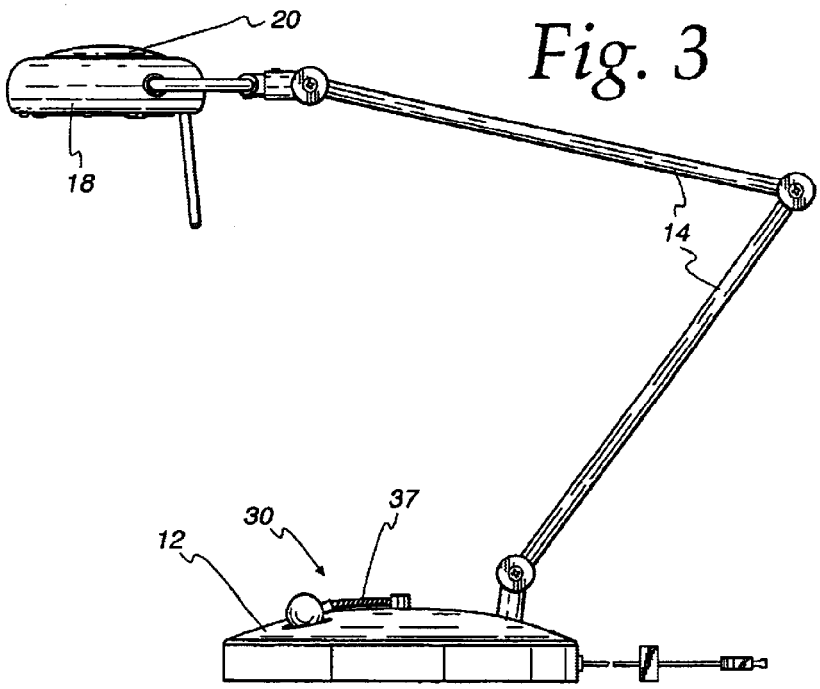
FIG. 3 is a left-side elevational view of the lamp shown in FIG. 2.

Turning more specifically to the drawings, a lamp 10 embodying the present invention includes a base 12 here taking the form of an articulating arm or standard 14 which mounts, in turn, a head or illuminating unit 16. This illuminating head 16 includes a light mount 18 enclosing a light 20. Importantly, this light 20 is of the high-intensity, low-voltage type, such as that manufactured by, for example, the Jiangson Wujin Fuxing Electrical Appliance Company, Ltd. of Chang Zhou, Jiangsu, China. A power cord 22 extends from a remote source of electric power of standard variety to the lamp base 12. Accordingly, the power cord 22 in includes a plug 24. A transformer 26 converts the standard domestic power (for example, 120 volts, 60 Hz AC) to a 12 volt alternating current which the light 20 is designed to utilize. The transformer can be obtained from the Yang Guang Electronic Company of Beian Industry District, Huang Jiang Dong Guan, Guang Dong, China.

Wiring (not shown) provides a normal electrically conductive path extending from the remote power source through the power cord 22 to a novel low voltage on-off switch 30, and from the novel switch 30 up through the arm 14 to the light 20.

The illustrated lamp base 12 mounts and supports both the arm 14 and a novel switch 30. In accordance with one object of the invention, this novel switch 30 is attractive yet its operation is self-evident to any user. Although electric current passes directly through the switch 30, that current is of low voltage and is consequently harmless. In accordance with this aspect of the invention, the switch 30 includes a first pole 32 permanently connected, through the electrically conductive path 22, to the transformer 26 and the remote power source (not shown) via the plug 24. A second pole 34 is permanently connected, via the electrically conductive path, to the light 20. A movable switch element 36 here includes a flexible, electrically conductive cable 37 which is fixed at one end to the first pole, and an electrically conductive ball 38 is mounted at the cable free end. The flexible cable 36 is electrically connected at a fixed end to the first pole 32, and at its free end to the ball 38. A third pole 48 is also located on the base 12, and it is spaced apart from the second pole 34.

The second pole 34 takes the form of a small cup adapted to receive and retain the ball 38, and is formed of a suitable metal or other electrically conductive material. Similarly, the third pole 48 takes the form of a small cup adapted to receive and retained that ball 38, but it is formed a plastic or other electrically insulated material. When the lamp is connected to the remote power source and the ball 38 rests in the conductive second pole cup 34, the lamp is on; and when the ball 38 rests in the insulated third pole cup 40, the lamp is off. It will be self-evident to any lamp user that the lamp may be turned on or off by moving the ball 38 between the cups 34 and 48.

What is claimed is:

1. A lamp, comprising, in combination, a low voltage light, a low voltage lamp switch, an electrically conductive path extending from a standard power source through the low voltage switch to the low voltage light, a transformer interposed in the electrically conductive path between the power source and the switch to provide low voltage at the switch, the switch including a first pole permanently connected, through the electrically conductive path, to the transformer, a second pole permanently connected, through the electrically conductive path, to the light, and a movable switch element permanently connected to the first pole and selectively movable into and out of electrical connection with the second pole wherein said movable switch element includes a fixed end permanently connected to the first pole and a free end selectively movable into and out of electrical connection with the second pole, wherein the switch element free end is a ball, and wherein said second pole is a cup adapted to receive the switch element free end ball.

2. A lamp according to claim 1 wherein said switch element includes a flexible cable electrically connecting the switch element fixed end and free end.

3. A lamp according to claim 1 wherein said switch element includes a third pole electrically insulated from said light, and positioned to selectively and mechanically engage the switch element free end, whereby, when the switch element free end is retained by the insulated third pole, the light is off.

4. A lamp according to claim 3 wherein said switch element insulated third pole is a cup adapted to receive a ball.

5. A lamp according to claim 1 wherein said switch element second pole is electrically connected to the light, whereby, when the switch element free end is electrically connected to the second pole, the light can be on.

6. A lamp according to claim 1 further including a base supporting said light.

7. A lamp according to claim 1 further including a base mounting said switch.

8. A lamp according to claim 7 wherein said switch includes a first pole mounted to said base.

9. A lamp according to claim 7 wherein said switch second pole is mounted to said base, and wherein said second pole comprises a cup adapted to receive a switch element free end ball and wherein said second pole is electrically connected, through the electrically conductive path, to the light.

10. A lamp according to claim 7 wherein said switch includes a third pole mounted to the base, and wherein said third pole comprises a cup mounted to the base but electrically insulated from said electrically conductive path.

11. A lamp base mounting a low-voltage switch for a low-voltage lamp, the switch including a first pole permanently connected to a source of electric power, a second pole permanently connected to a light, and a movable switch element permanently connected to the first pole and selectively movable into and out of electrical connection with the second pole wherein said movable switch element includes a fixed end permanently connected to the first pole and a free end selectively movable into and out of electrical connection with the second pole, wherein the switch element free end is a ball, and wherein said second pole is a cup adapted to receive the switch element free end ball.

12. A lamp base according to claim 11 wherein said switch element includes a flexible cable permanently connected to the first pole and having a free end.

13. A lamp base according to claim 12 wherein said switch element includes a third pole electrically insulated from said light, and positioned to selectively and mechanically engage the switch element free end, whereby, when the switch element free end is retained by the insulated third pole, the light is off.

14. A lamp base according to claim 13 wherein said switch element insulated third pole is an electrically insulated cup adapted to receive the switch element free end ball.

* * * * *